United States Patent [19]

Saccoccio

[11] 4,086,738

[45] May 2, 1978

[54] KIT AND COMPONENTS FOR CONSTRUCTING DECORATIVE POLYHEDRALS

[76] Inventor: Louis Saccoccio, 25 St. Mary's Dr., Cranston, R.I. 02920

[21] Appl. No.: 731,788

[22] Filed: Oct. 12, 1976

[51] Int. Cl.[2] ..... F04C 1/42

[52] U.S. Cl. ..... 52/270; 52/308; 52/581; 52/648; 47/44; 362/352

[58] Field of Search ..... 52/581, 307, 308, 314, 52/DIG. 10, 270, 646, 648, 663; 46/30, 31, 25, 26, 21, 1, 17, 19; 35/73; 428/15, 14, 33; 240/10 R, 2 R, 41.55; 47/44

[56] References Cited

U.S. PATENT DOCUMENTS

| | | | |
|---|---|---|---|
| 262,863 | 8/1882 | Walters | 46/30 |
| 2,440,449 | 4/1949 | Raemer | 52/82 |
| 2,918,992 | 12/1959 | Gelsavage | 52/81 |
| 3,534,519 | 10/1970 | James | 52/581 |
| 3,777,359 | 12/1973 | Bardot | 52/DIG. 10 |
| 3,953,949 | 5/1976 | O'Sheenan | 52/82 |

FOREIGN PATENT DOCUMENTS

| | | | |
|---|---|---|---|
| 796,463 | 10/1968 | Canada | 52/81 |

*Primary Examiner*—John E. Murtagh
*Attorney, Agent, or Firm*—Robert J. Doherty

[57] ABSTRACT

A kit for constructing a decorative polyhedral structure is described in which a plurality of interlocking planar matrices are provided, each matrix being in the shape of a polygon with at least two straight isosceles sides and having interstices in which a fusible or settable plastic decorative material is introduced and set prior to construction of the polyhedron shape.

7 Claims, 4 Drawing Figures

KIT AND COMPONENTS FOR CONSTRUCTING DECORATIVE POLYHEDRALS

DETAILED DESCRIPTION

There is presently available on the market "stained glass" kits from which various decorative objects can be fabricated. In these, colored thermoplastic material is introduced into the interstices of a planar metal matrix. Upon heating the thermoplastic material at relatively low temperatures, such as in an ordinary home oven, the thermoplastic material fuses and fills the interstice in which it has been placed. Upon cooling the plastic material solidifies and adheres to the matrix. The resultant decorative device can then be utilized in any number of ways, as for example a keychain holder, window shade pull or simply as an ornamental object.

The present invention is directed at a novel matrix of this type which is operable to receive such a fusible or settable, plastic decorative material and retain the same after setting. The present matrix however is modular so that a plurality of them can be combined and locked to form a polyhedral shape. The precise polyhedron shape is a matter of choice with the designer and may include, without limitation, a tetrahedron, cube, pyramid or the like and combinations of these.

The nature and objects of the invention will be apparent from the following description and the accompanying drawings in which FIG. 1 is a perspective exploded view of several matrices in one configuration according to the present invention;

Figure 1:
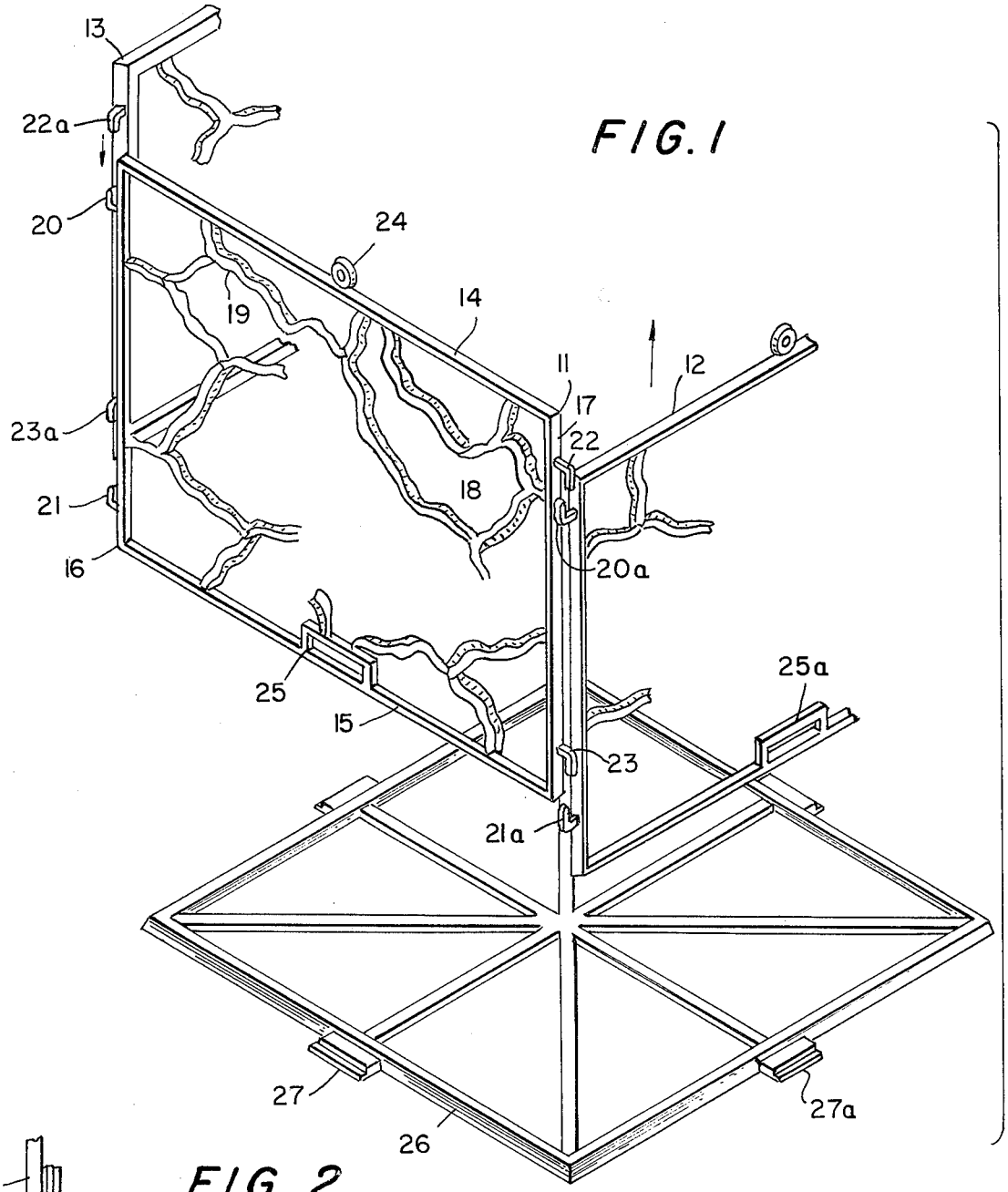
Figure 2:
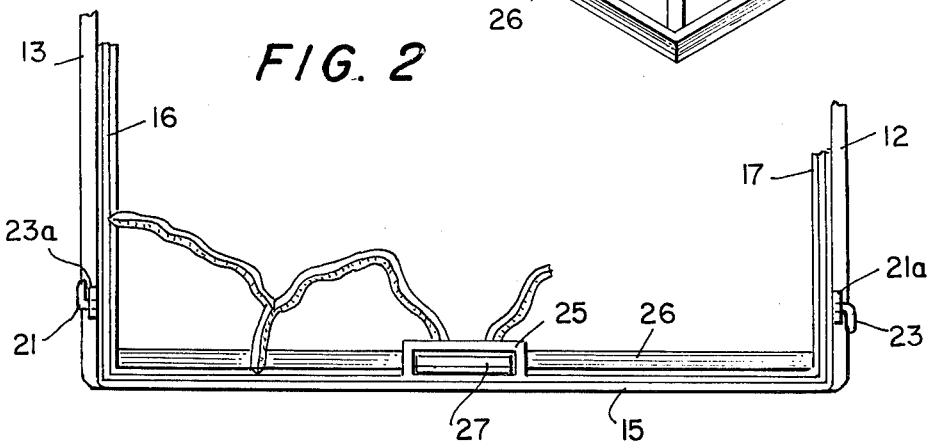
FIG. 2 is an elevation of a portion of the matrices shown in FIG. 1.

Referring now to FIGS. 1 and 2, there are shown portions of three matrices 11, 12 and 13 each of which is identical with the others. These are intended for use with a fourth matrix (not shown) of substantially the same structure. Referring to matrix 11, which except as noted below is representative, a continuous polygonal configuration is defined by a coplanar edge strip having four portions 14, 15, 16 and 17. The term polygonal configuration refers to an isosceles polygon, that is having at least two equal sides. It is not necessary that the polygon be regular, that is that all sides are of equal length, nor that all angles are congruent. Generally the isosceles legs will intersect or will be separated by a single common side (base) and define congruent angles with respect to that side. The polygonal configuration may be that of an equilateral or isosceles triangle, an isosceles quadrangle including an isosceles trapezoid, a rectangle or square, as well as higher polygons in which at least two sides are of equal length.

Within the edge strip, but attached to at least one point, is at least one coplanar interior strip portion 18 (and 19) which defines decorative interstices within the edge strip. A settable plastic decorative material can be introduced into these interstices and retained after fusing or setting. Thus, for example, particles of a thermoplastic polymeric material having a relatively low melting point are introduced into the interstices. Upon application of heat, as for example in an ordinary home oven, the plastic material fuses and fills the interstice. This operation is conventionally carried out with the matrix lying over a backing material, such as aluminum foil. The edge strip portions and interior strip portions are thus perferably coplanar.

A first portion of the edge strip 16 has first engagement means 20 and 21 disposed thereon and a second portion 17 has second engagement means 22 and 23. First and second engagement means 20, 21; 22, 23 will complement each other and are operable to engage corresponding engagement means on other matrices. In the embodiment shown, the engagement means are opposed hooks but others will immediately be apparent to workers in the art. For example, the matrices may be joined by clips, bolts, adhesives and the like. Second engagement means 22 and 23 on matrix 11 are downwardly disposed hooks and identical with engagement means **22*a* and 23*a* on matrix 13 while first engagement means 20 and 21 on matrix 11 are upwardly disposed hooks and identical with engagement means 20*a* and 21*a* on matrix 12**. As a result of this disposition of complementing engagement means on opposite sides of the polygonal configuration, a plurality of like matrices may be easily assembled so as to form a tetrahedral shape.

It is to be appreciated that the engagement means are provided with angulation to accommodate the eventual alignment of the individual faces of the polyhedron. Thus in the embodiment shown in FIG. 1 in which the engagement means are simple hooks intended to engage one another perpendicularly, the channel of the hook is disposed at 90°. If the final polyhedron were, for example, hexagonal in a cross section, the hook would be adapted to receive a second matrix at an angle of 60°, either by angulation of the hook or by disposing the channel of each at 30° off the perpendicular.

Various auxiliary fixtures may be incorporated in one or more of the matrices. Thus in the embodiment of FIG. 1, eye 24 is disposed on the top surface of matrix 11. A similar eye on the fourth matrix (not shown), or on all four matrices, thus provides means for suspending the polyhedral structure, as for example when it is utilized as a plant hanger, lantern, or the like. Other fixtures will immediately be apparent to those skilled in the art. Thus for example the elements of a hinge may be disposed on the edge strip portion of one matrix, thereby permitting the incorporation of a hinged lid into the polyhedral structure, as for example in the case of a jewelry box or cigarette box. Other auxiliary fixtures which can be incorporated include the elements of a latch or elements of a mounting bracket.

It is apparent from the foregoing that a plurality of like matrices can be utilized in forming the polyhedral structure or one or more matrices may be employed which, while complementing the remaining matrices in terms of the first and second engagement means and the edge strip portions upon which these are disposed, will be differentiated by the presence of auxiliary fixtures. Likewise, while the edge strip portions bearing the engagement means of all matrices in a given kit will generally be of the same length, the remaining edge strip portions of several matrices may differ. In this fashion, it is thus possible to construct a polyhedral having different width and length dimensions. If identical matrices are employed, the cross-section of the resulting polyhedral will of course be that of a regular polygon. Similarly, various combinations are possible. For example, four square matrices can be combined to form four sides of a cube and four triangular matrices can in turn be combined to form a pyramid which is then joined to one of the open sides of the cube.

These various possibilities for utilization of these matrices can of course be designed by the manufacturer with specific components grouped together in a kit for a predetermined polyhedral structure. Alternatively, a variety of different matrices may be grouped together in a kit, thereby permitting the purchaser to construct a variety of polyhedral structures of his or her own selection and design.

Returning to FIG. 1, there may also be provided in the matrix a third engagement means 25 on a third portion 15 of the edge strip which is operable to engage a planar base member 26 through fourth engagement means 27. Thus tongue 27 engages slot 25 on matrix 11 and tongue 27*a* engages slot 25*a* in matrix 12. A rigid box-like structure thus results when the four matrices are interlocked through their engagement means and the four tongues on the four sides of base member 26 engage the corresponding slots of the four matrices.

Base member 26 may be designed solely on the basis of structural requirements or may also be a matrix operable to receive a settable plastic material in the same fashion as is described above.

Figure 3:
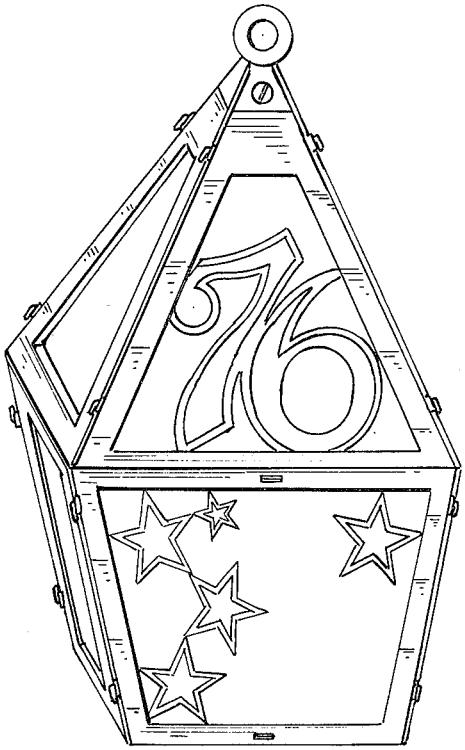
FIG. 3 is a perspective view of a second polygonal configuration utilizing matrices according to the present invention.
Figure 4:
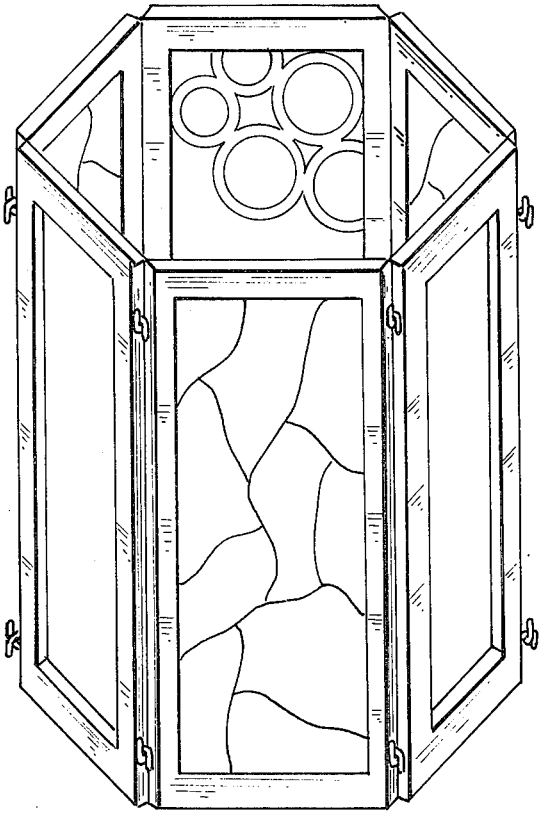
FIG. 4 is a further alternative polygonal configuration utilizing matrices according to the present invention.

FIG. 3 and FIG. 4 depict alternative polyhedral shapes which can be formed utilizing similar matrices or combinations of the same. The matrix is preferably formulated from metal or plastic, as by casting, injection, molding or the like.

In view of the inherent flexibility of my invention and the foregoing disclosure and drawings, variations and modifications meeting individual whim or particular need and providing all or part of the benefits and objectives of my invention without copying the particular embodiment shown will doubtlessly become evident to others skilled in the art and I therefore claim all such modifications as fall within the reasonable spirit and scope of my claims.

What is claimed is:

1. A decorative article of polyhedral shape comprising a base and a plurality of adjacently disposed sidewalls upstanding therefrom and positioned with respect to each other so as to form a generally closed perimeter, said sidewalls having a continuous coplanar edge strip defining elements of a polygonal configuration, and at least one coplanar interior strip portion attached to said edge strip and defining decorative interstices within said edge strip for receipt of settable plastic material, said edge strip having at least first and second generally opposed edge strip portions thereof generally equal length such that the first edge strip portion or each sidewall is positioned adjacent a second edge strip portion of an adjacent sidewall, first engagement means disposed on said first edge strip portions and second engagement means disposed on said second edge strip portions, said first and second engagement means comprising downwardly and upwardly opening hooks respectively, said first and second hooks adapted to interengage each other and third and fourth engagement means provided on those strip portions proximal said base and said base respectively, said third and fourth means adapted to interengage each other.

2. The decorative article of claim 1, including means on said sidewall sides distal from said base for suspending said article.

3. The decorative article of claim 1, wherein said edge strip includes a third portion disposed between said first and second strip portions, said third engagement means disposed on said third strip portion.

4. The decorative article of claim 2, said suspension means comprising eyes provided on the top surface of a fourth strip portion disposed between said first and second portions and generally in opposed disposition with respect to said third portion.

5. The decorative article according to claim 1 wherein said edge strip defines an isosceles trapezoid.

6. The decorative article according to claim 1 wherein said edge strip defines a rectangle.

7. The decorative article according to claim 1 wherein said third and fourth engagement means are a slot and tongue, respectively.

* * * * *